US012054905B2

(12) United States Patent
Ehlers

(10) Patent No.: US 12,054,905 B2
(45) Date of Patent: Aug. 6, 2024

(54) FLOATING FOUNDATION

(71) Applicant: Jan Gerhardus Ehlers, Centurion (ZA)

(72) Inventor: Jan Gerhardus Ehlers, Centurion (ZA)

( * ) Notice: Subject to any disclaimer, the term of this patent is extended or adjusted under 35 U.S.C. 154(b) by 47 days.

(21) Appl. No.: 17/440,854

(22) PCT Filed: Jan. 31, 2020

(86) PCT No.: PCT/IB2020/050784
§ 371 (c)(1),
(2) Date: Sep. 20, 2021

(87) PCT Pub. No.: WO2020/157715
PCT Pub. Date: Aug. 6, 2020

(65) Prior Publication Data

US 2022/0145571 A1 May 12, 2022

(30) Foreign Application Priority Data

Feb. 1, 2019 (ZA) ..... 2019/00677

(51) Int. Cl.

| | |
|---|---|
| ***E02D 27/02*** | (2006.01) |
| ***E04B 5/21*** | (2006.01) |
| ***E04B 5/32*** | (2006.01) |
| ***E04B 5/36*** | (2006.01) |
| ***E04C 5/16*** | (2006.01) |
| ***E04G 11/00*** | (2006.01) |
| ***E04G 17/14*** | (2006.01) |

(52) U.S. Cl.
CPC ..... *E02D 27/02* (2013.01); *E04C 5/168* (2013.01); *E04G 11/00* (2013.01); *E04G 17/14* (2013.01); *E04B 5/21* (2013.01); *E04B 5/326* (2013.01); *E04B 5/36* (2013.01)

(58) Field of Classification Search
CPC ..... E02D 27/02; E02D 27/32; E04C 5/168; E04G 11/00; E04G 17/14; E04G 11/46; E04G 13/00; B63B 35/38; E04B 5/26; E04B 5/28; E04B 5/36; E04B 5/21; E04B 5/326
See application file for complete search history.

(56) References Cited

U.S. PATENT DOCUMENTS 4,831,803 A * 5/1989 Leonardis ..... E04C 5/168 52/577
6,550,207 B1 4/2003 Pontarolo
(Continued)

FOREIGN PATENT DOCUMENTS

AT 316821 B 7/1974
CA 2671130 A1 * 6/2008 ..... E02D 27/01
(Continued)

*Primary Examiner* — Kyle J. Walraed-Sullivan
*Assistant Examiner* — Omar F Hijaz
(74) *Attorney, Agent, or Firm* — The Webb Law Firm

(57) ABSTRACT

A casting kit for constructing a foundation which includes a plurality of void forming members, each of which has securing means on its sides to secure to a matched void forming member thereby to define a minor void forming formation and at least one side of each void forming member having a step formation such that a groove is formed between the step formation of adjacent void forming members in a minor void forming formation for receiving tensile elements in the groove.

16 Claims, 11 Drawing Sheets

(56) References Cited

U.S. PATENT DOCUMENTS

| | | | | |
|---|---|---|---|---|
| 7,516,587 | B2 * | 4/2009 | Barlow | E04F 15/105 52/177 |
| 8,919,054 | B2 * | 12/2014 | Tillery | E04F 15/02038 52/177 |
| 10,584,487 | B2 * | 3/2020 | Caboni | E04C 5/168 |
| 2003/0061772 | A1 * | 4/2003 | Bertolini | E04F 15/043 52/177 |
| 2007/0214740 | A1 | 9/2007 | O'Grady | |

FOREIGN PATENT DOCUMENTS

| | | | | | |
|---|---|---|---|---|---|
| CN | 1804274 | A | | 7/2006 | |
| EP | 1335073 | A2 | | 8/2003 | |
| GB | 2385071 | A | * | 8/2003 | E02D 27/02 |
| WO | 0052279 | A1 | | 9/2000 | |
| WO | 2005061804 | A1 | | 7/2005 | |
| WO | WO-2007024201 | A1 | * | 3/2007 | E04G 11/10 |
| WO | 2016077890 | A1 | | 5/2016 | |
| WO | WO-2016077890 | A1 | * | 5/2016 | E02D 27/01 |

* cited by examiner

FLOATING FOUNDATION

CROSS-REFERENCE TO RELATED APPLICATIONS

This application is the United States national phase of International Application No. PCT/IB2020/050784 filed Jan. 31, 2020, and claims priority to South African Patent Application No. 2019/00677 filed Feb. 1, 2019, the disclosures of which are hereby incorporated by reference in their entirety.

BACKGROUND OF THE INVENTION

Field of the Invention

This invention relates to a floating foundation for a building. In particular, the invention relates to a casting kit, to a clamp, a method of constructing a foundation for a building and a foundation for a building.

Description of Related Art

The usual practice for constructing a foundation is to excavate a number of trenches, position reinforcing rods and reinforcing mesh in and over the trenches, and then pour concrete to embed the reinforcing rods within the trenches and to cover the surrounding areas.

Not only is this known process expensive, but when unstable soil is required to support the foundation, there is a high degree of probability that the foundation will crack if the effective volume of soil under the foundation varies with moisture content variation, as is typical in moist climates.

The inventor is aware of current techniques for building floating foundations, by creating voids or hollows within the foundations so as to form a "waffle grid" with the deep foundation beams being separated by voids. Current "waffle grid" foundations do not provide adequate strength to the foundation due to the voids or hollows within the foundation. Because current "waffle grid" foundations are built on top of the ground level they not suited in areas where erosion occurs as soil is eroded underneath these foundations.

It is the purpose of the current invention to overcome these shortcomings of current "waffle" type floating foundations.

SUMMARY OF THE INVENTION

Broadly according to a first aspect of the invention there is provided a casting kit for constructing a foundation which includes;

a plurality of void forming members, each of which has securing means on its sides to secure to a matched void forming member thereby to define a minor void forming formation, at least one side of each void forming member having a step formation such that a groove is formed between the step formation of adjacent void forming members in a minor void forming formation for receiving tensile elements in the groove.

The groove formed between adjacent void forming members may be shaped to receive tensile elements in the form of reinforcing steel bars as well as a settable material, the reinforcing steel bars and settable material defining supporting ribs of the foundation.

The void forming member may be in the form of a cuboid having a hollow interior with a planar top face.

The interior of the void forming member may have integrally formed supporting formations in the form of a prism shaped structure. The prism shape may be selected from any one of a triangular prism, a square prism, a pentagonal prism, a hexagonal prism, or the like.

The step formation may be located on a lower portion of at least one side of the void forming member.

The sides provided with step formations may be determined by the number of void forming members that define a minor void forming formation. For example, if four void forming members defines a minor void forming formation, then two sides of each void forming member will have a step formation.

The securing means may be in the form of a tongue and groove joint.

The tongue and groove joint may be located in a lower portion of the member.

The tongue and groove joint may be located on the sides of the step formation of the member. The groove of the tongue and groove formation being referred to as a groove formation to distinguish it from the groove defined by two adjoining step formations.

The minor void forming formation may be defined by four void forming members secured to each other such that the step formations between the void forming members form a cross-shaped groove running across the top face of the minor void forming formation, each void forming member having two step formations located on adjoining sides of the member, with the tongue located in the step formation on one side and the groove formation located in the step formation on the adjoining side to allow the tongue to engage with the groove on an adjacent member.

The kit may include a spacer capable of securing a plurality of minor void forming formations spaced apart of one another thereby to define a major void forming formation.

The spacer may be shaped and dimensioned to secure the minor void forming formations to one another while maintaining a gap between adjacent minor void forming formations such that, in use, reinforcing steel bars can be placed in said gaps and a settable material can be casted into said gaps.

The spacer may be in the form of a planar member with holding formations, on the edges of the planar member, shaped and dimensioned to engage a corner of a void forming member in a minor void forming formation.

The spacer may include a central member extending upwardly from the planar member with semicircular cutouts capable of receiving the reinforcing steel bars.

The void forming members may be manufactured from any one of polystyrene and polyethylene or the like using injection moulding, 3D printing, thermoforming or the like.

The void forming members may have a minimum side length of 400 mm and a maximum side length of 800 mm.

The casting kit may include shuttering to be arranged around major void forming formations, in use to create edge beams when a settable material is cast around the major void forming formations.

The shuttering may be in the form of an elongated wood cladded member.

The shuttering may be in the form of wooded cladded polystyrene panel.

According to another aspect of the invention, there is provided a clamp, which includes a baseplate having attachment formations onto which a gripper is removably attachable;

a gripper having a base being removably attachable to the baseplate, an adjustable arm hingedly connected to the base and a threaded rod/nut combination extending from the base to the arm to clamp the adjustable arm towards the base; and slots defined in the base of the gripper and the adjustable arm shaped and dimensioned to receive planer shuttering in an upright orientation.

The attachment formations of the baseplate may be in the form of an alignment pin and a bolt/nut combination.

The base of the gripper may be provided with a keyhole formation and slot to engage the alignment pin and bolt/nut combination of the baseplate.

The invention extends to a method of constructing a foundation for a building which includes;

excavating in a foundation site boundary foundation trenches which defines the outer boundary of the foundation;

installing shuttering on the outside of the boundary foundation trenches;

attaching void forming members to one another to define minor void forming formations, the minor void forming formations having grooves defining moulds for supporting ribs and placing the minor void forming formations inside the shuttering;

securing a plurality of minor void forming formations in spaced relationship to one another to define a major void forming formation, the voids between the major void forming formations defining moulds for stiffening ribs;

placing reinforcing steel bars into the voids between the major void forming formations and the grooves in the minor void forming formations;

casting a settable material into shuttering to form edge beams, supporting ribs, stiffening ribs and a slab on top of the void forming members covering the foundation site.

The method may include additionally excavating a grid of intersecting foundation trenches before installing the shuttering, the grid defined by two sets of substantially parallel trenches, the two sets of substantially parallel trenches intersecting each other, the grid of intersecting foundation trenches being in register with a major void forming formation to be installed between the trenches, the intersecting foundation trenches defining moulds for internal beams.

The spacing between adjacent internal beams may be between 1.2 m and 4 m.

The spacing between adjacent stiffening ribs may be between 1.7 m and 4 m.

The width of the step formation of each void forming member may be between 25 mm and 75 mm such that the groove defined by the step formation in the minor void forming formation is between 50 mm and 150 mm.

The method may include the prior step of levelling an area to obtain the foundation site and arranging a plurality of insulating panels abutting each other over the foundation site.

The boundary foundation trenches and the grid of intersecting foundation trenches may have a depth of between 100 mm and 1500 mm.

According to yet another aspect of the invention, there is provided a foundation for a building which includes;

a plurality of void forming members, the void forming members positioned on top of a foundation site in a pattern which defines a minor void forming formation, a plurality of minor void forming formations attached in spaced apart relationship to define a major void forming formation;

a plurality of edge beams located around an outer boundary of the foundation; the plurality of edge beams extending into the surface of the foundation site;

a plurality of internal beams located between each major void forming formation, the plurality of internal beams extending into the foundation site;

a plurality of stiffening ribs formed by tensile elements and settable material between minor void forming formations running the across the major void forming formation;

a plurality of supporting ribs formed by tensile elements and settable material casted into a groove formed between two adjacent minor void forming members; and a reinforced slab extending over the void forming members between the edge beams.

BRIEF DESCRIPTION OF THE DRAWINGS

The invention is now described, by way of non-limiting example, with reference to the accompanying figure(s).

In the Figure(s).

In the drawings, like reference numerals denote like parts of the invention unless otherwise indicated.

DESCRIPTION OF THE INVENTION

Figure 1:
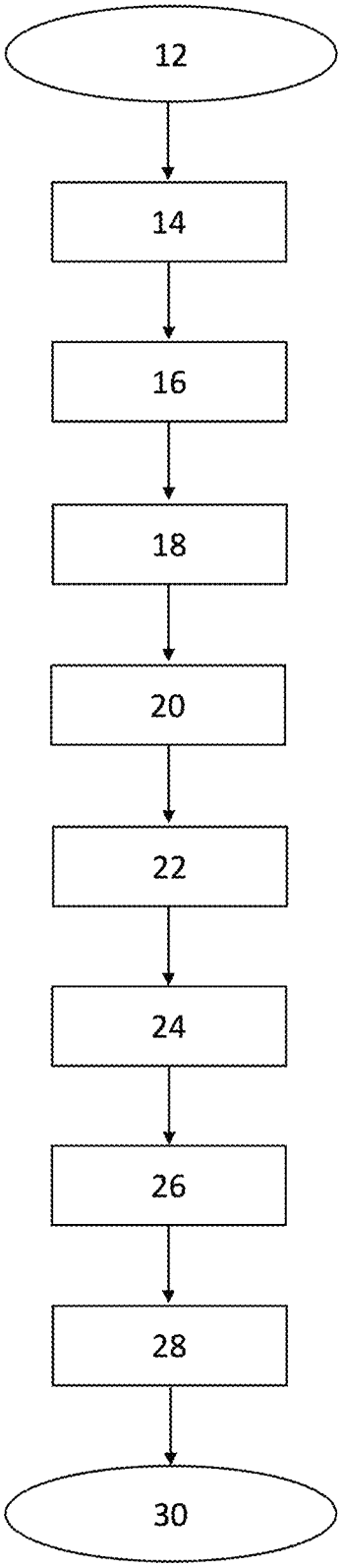
FIG. 1 shows a flow diagram of a method of constructing a foundation.

In FIG. 1 reference numeral (10) refers to a flow diagram of a method of constructing a foundation. The method of constructing a foundation starts at step (12) with preparing an area to substantially the same level to create a site on which the foundation is to be constructed thereby defining a foundation site. The method further includes an optional step (14) of arranging a plurality of insulating elements abutting each other onto the foundation site to form a continuous layer over the foundation site. This step (14) is however not always required as void forming members acts as insulating members.

At step (16) the method includes excavating in the foundation site a plurality of trenches which defines the outer boundary of the foundation. The outer boundary trenches are formed by means of a trenching machine and having a depth of between 100 mm and 1500 mm. At step (18) shuttering is placed on the outside of the boundary trenches. At step (20) a grid of intersecting foundation trenches are formed, the grid is defined as two sets of substantially perpendicular trenches, each trench of each set intersecting at least one trench of the other set. The foundation trenches having a spacing of between 1.2 m and 4 m between each other.

At step (22) a plurality of void forming members are attached to one another within the boundary foundation trenches on the foundation site. The void forming members are secured to one another to define a minor void forming formation. Each void forming member includes a step formation (see FIG. 4) such that once the void forming members are secured to one another the step formations of adjacent void forming members form a groove across the minor void forming formation into which tensile elements are receivable to define supporting ribs.

At step (24) a plurality of minor void forming formations are secured to one another to define a major void forming formation. The intersecting foundation trenches which are formed at step (20) is spaced to be in register with a major void forming formation to be installed between intersecting trenches. The minor void forming formations are secured with a spacer to provide a passage between each minor void forming formation into which tensile elements are receivable to define stiffening ribs.

At step (26) tensile elements are placed into the grooves in the minor void forming formations to obtain supporting ribs and between each minor void forming formation in each major void forming formation to obtain stiffing ribs.

At step (28) a settable material is casted in the boundary trenches between the void forming members and shuttering to obtain edge beams. The settable material is also casted into the grid of intersecting parallel trenches at step (28) to obtain internal beams between each major void forming formation.

The method ends at step (30) where a settable material is casted over the edge beams, the internal beams, the void forming members and tensile elements placed inside the grooves and between each minor void forming member to obtain a slab on top of the void forming members covering the foundation site.

Figure 2:
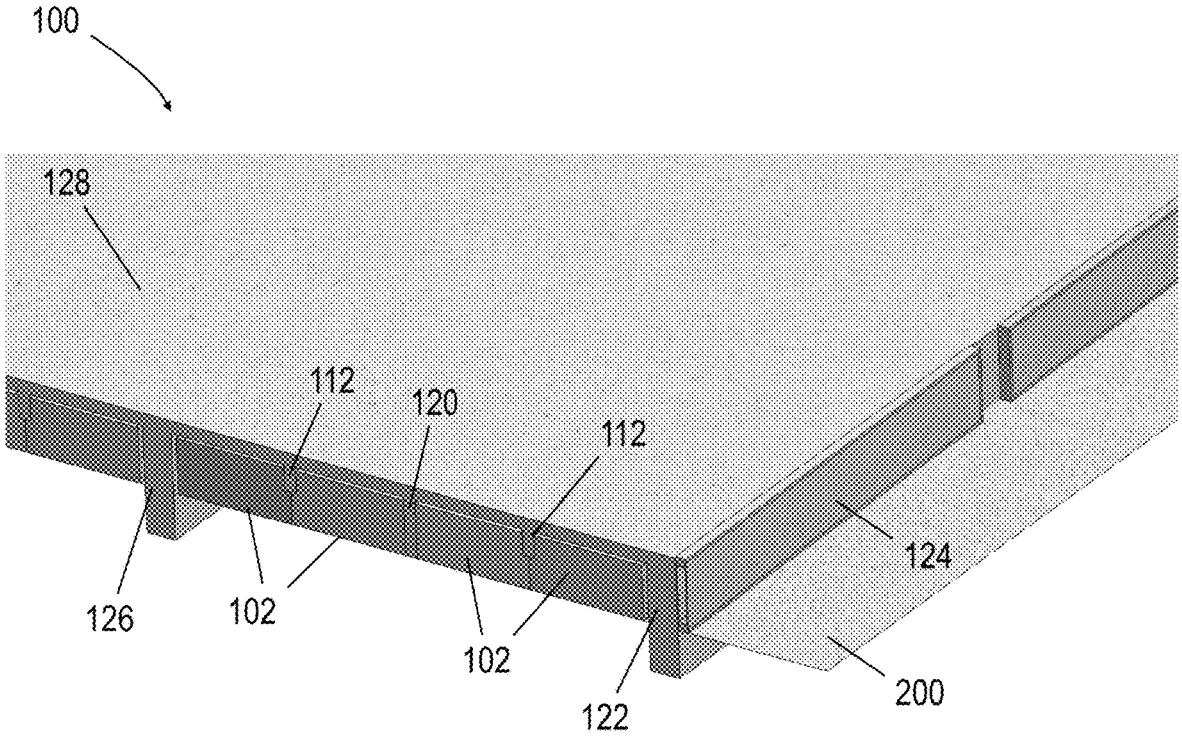
FIG. 2 shows a three-dimensional section of a foundation constructed using the method shown in FIG. 1.

In FIG. 2 reference numeral (100) shows a section of a foundation which is constructed using the method as shown in FIG. 1. The foundation (100) is formed with a plurality of void forming members (102) (see FIGS. 3,4, and 14). The void forming members (102) are in the form of cuboids having a hollow interior with a planar top face (102.1). The interior of the void forming member (102.2) includes supporting formations in the form of a honeycomb structure (102.3) which is integrally formed with the interior of the member. It is to be appreciated that the internal structure can be any prism shaped structure, such as a triangular prism, a square prism, a pentagonal prism, a hexagonal prism (honeycomb), or the like.

The void forming members (102) further includes include a step formation (104) located on a lower portion of two sides of each void forming member.

Figure 3:
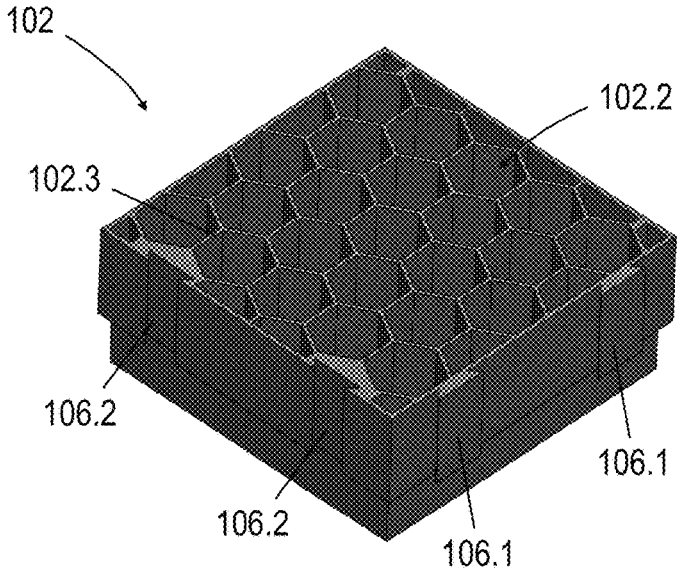
FIG. 3 shows a three-dimensional bottom view of a void forming member of the foundation shown in FIG. 2.
Figure 4:
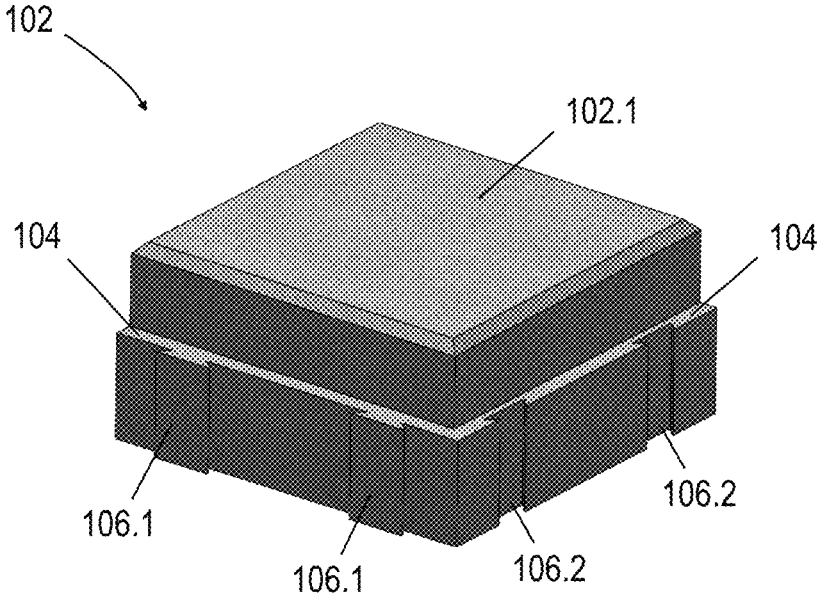
FIG. 4 shows a three-dimensional top view of the void forming member of FIG. 3.
Figure 14A:
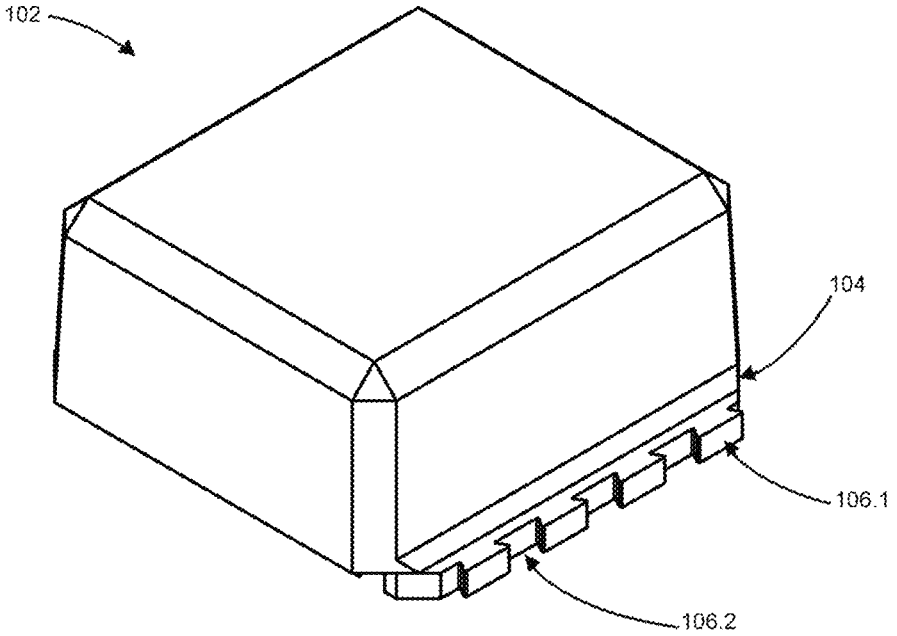
FIG. 14A shows a three-dimensional top view of another embodiment of a void forming member.
Figure 14B:
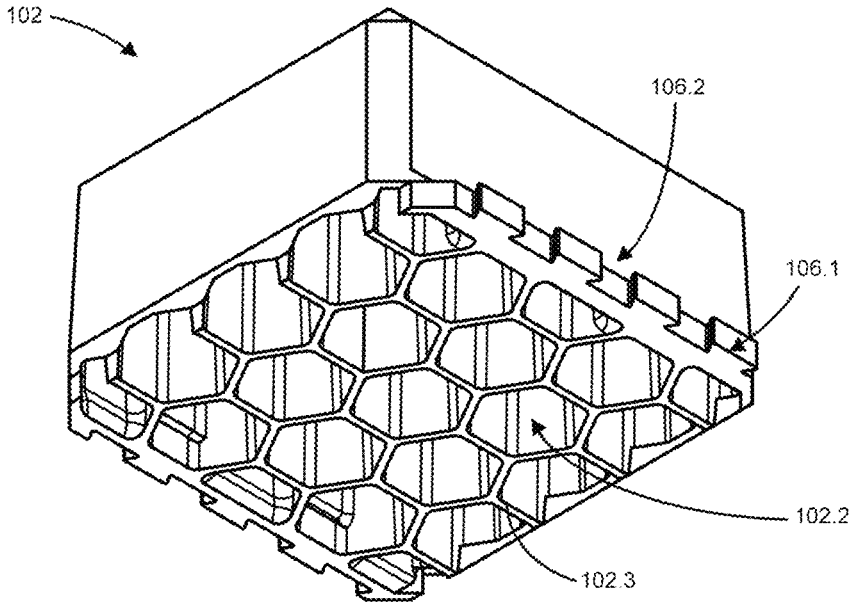
FIG. 14B shows a three-dimensional bottom view of the void forming member of FIG. 14*a* FIG. 14A.

Each void forming member (102) may further include securing means in the form of a tongue and groove joint (106) which is defined by tongues (106.1) on one void forming member (102) and corresponding grooves (106.2) in an adjacent void forming member (102). The tongues (106.1) and grooves (106.2) are located in the step formations (104) of two adjoining sides of each void forming member (102). As can be seen in FIGS. 3,4 and 14, the differences between the two embodiments is in the depth of the step formations (104) and the shape of the planar top surface. These characteristics give the two embodiments different applications in the design of the foundation.

Figure 5:
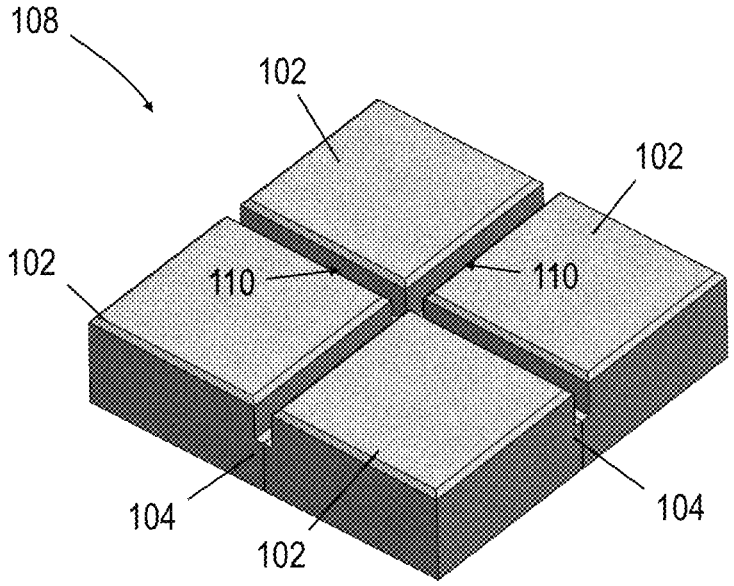
FIG. 5 shows a three-dimensional top view of a minor void forming formation comprising four void forming members.

As can be seen in FIG. 5, four void forming members (102) are secured to each other by sliding the tongues (106.1) of one member into the grooves (106.2) of an adjacent member to define the minor void forming formation (108. The step formations (104) of the adjacent members (102) forming the groove (110) between adjacent void forming members (102) such that a cross shaped groove (110) is formed across the minor void forming formation (108) and capable of receiving reinforcing steel bars (not shown) as well as a settable material, to form the supporting ribs (112).

Figure 6:
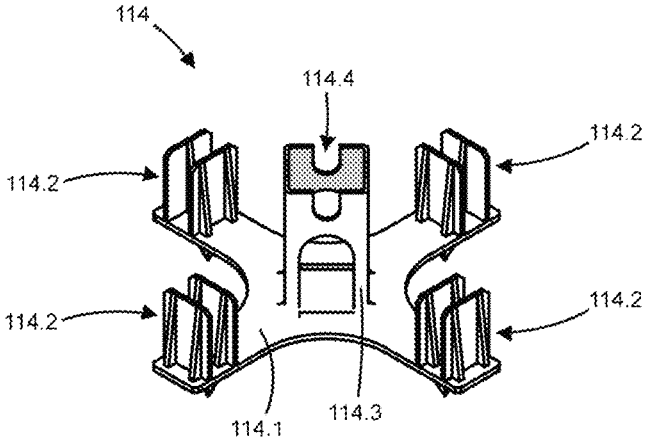
FIG. 6 shows a three-dimensional view of a spacer.
Figure 7:
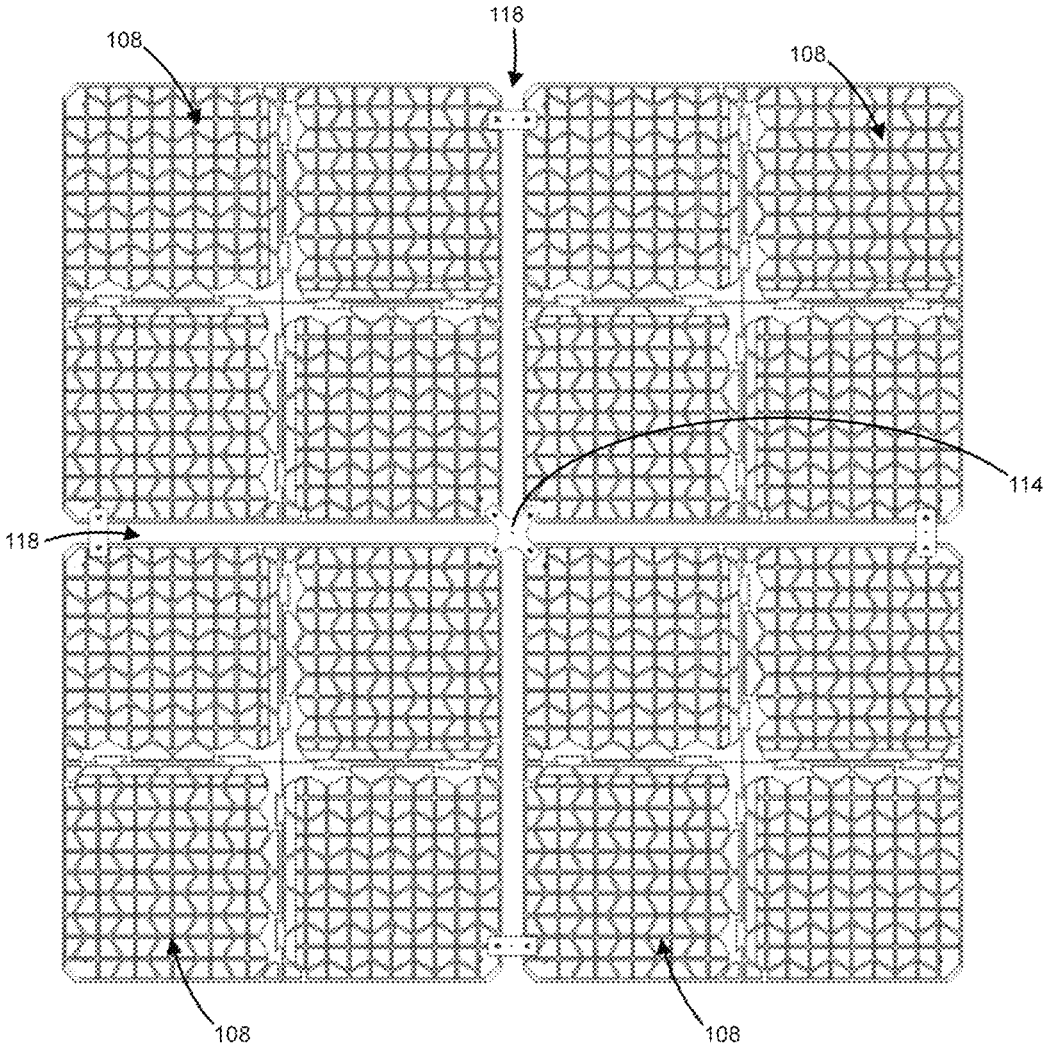
FIG. 7 shows a bottom view of four minor void forming members assembled together to define a minor void forming formation and four of these minor void forming formations being assembled to define a major void forming formation.

In FIG. 7 four minor void forming formations (108) are secured to each other via a spacer (114) (FIG. 6) to define a major void forming formation (116), being a combination of four minor void forming formations. The minor void forming formations (108) are spaced to provide a passage (118) between each minor void forming formation (108) into which reinforcing bars (not shown) are placed and settable material is poured to obtain the stiffening ribs (120) shown in FIG. 2.

The foundation (100), shown in FIG. 2 further includes a plurality of edge beams (122), formed by reinforcing bars (not shown) and a settable material casted into the outer boundary trenches. The edge beams (122) are located between the void forming members (102) and shuttering (124) and extend between 100 mm and 1500 mm into the foundation site (200). Together with the edge beams a plurality of internal beams (126) are formed between each major void forming formation (116) by reinforcing bars (not shown) and a settable material casted into the grid of intersecting trenches.

The shuttering (124) (see also FIG. 13) is in the form of elongated wooded cladded polystyrene members with a height defined to the void forming members (102) and the required thickness of the slab (128). It is to be appreciated that the inner portion may also be injected polyurethane foam, or the like.

The foundation section (100) includes a reinforced slab (128) casted over the void forming members (102) and between the edge beams (122). As can be seen, these components are all integrally formed in a single cast which makes it more time and cost efficient than independently casted components.

In FIG. 6 the spacer (114) is shown. The spacer is in the of a planar member (114.1) with holding formations (114.2), on the edges of the planar member (114.1), shape and dimension to receive a corner of the void forming members (102) in a minor void forming formation (108). The dimensions of the planar member may be different in different embodiments to allow the passage (118) between minor void forming formations (108) to differ. The spacer (114) further includes a central member (114.3) extending upwards from the planar member (114.1) with semicircular cut-outs (114.4) for receiving and holding the reinforcing bars (not shown) in place.

Figure 8:
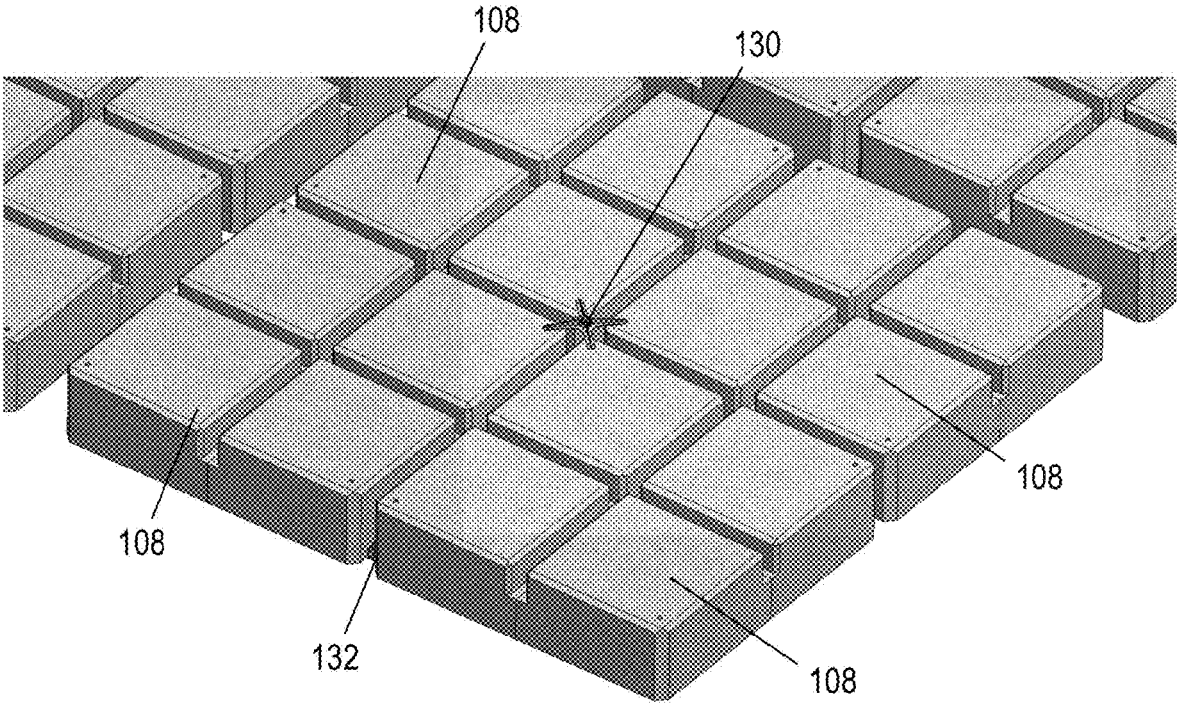
FIG. 8 shows a three-dimensional top view of the major grid forming formation with additional spacers at the top.

In FIG. 8 a major and minor void forming formation according to a second aspect of the invention is shown. In this aspect, each void forming member (102) includes a socket (102.4) located in a corner of the top face of the void forming member (102) onto which a first additional spacer (130) is mountable.

Figure 9:
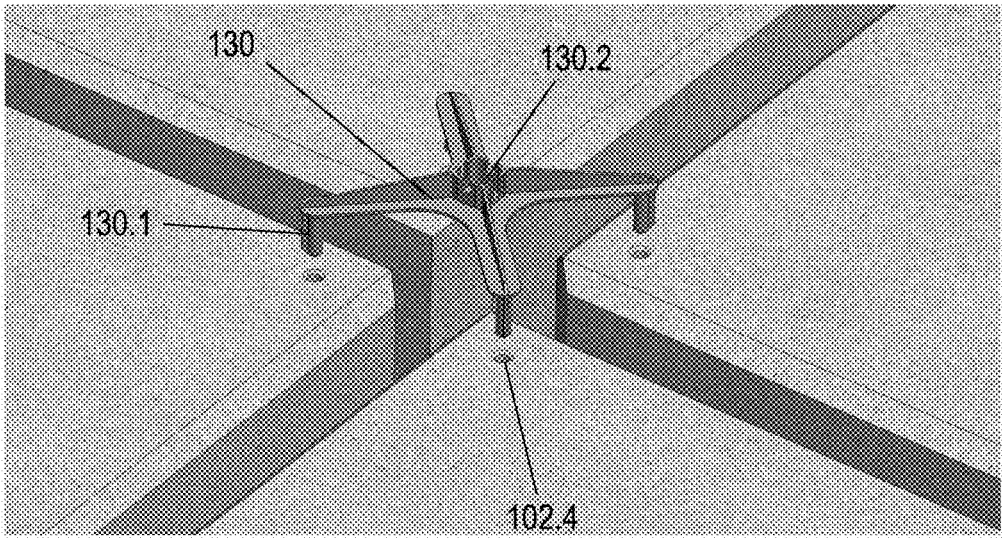
FIG. 9 shows a three-dimensional view of the first additional spacer as shown in FIG. 8 in use.

The first additional spacer (130) (see FIG. 9) includes four spigots (130.1), shape and dimension to be received by the circular apertures (102.4) of the void forming members (102) to secure the members in a major void forming formation (116). The spacer (130.1) includes a central pillar (130.2) with semicircular cut-outs (130.3, 130.4) of different depths for receiving and holding the reinforcing bars (not shown) in place. The different depths of the cut-outs are to accommodate two reinforcement bars crossing each other.

Figure 10:
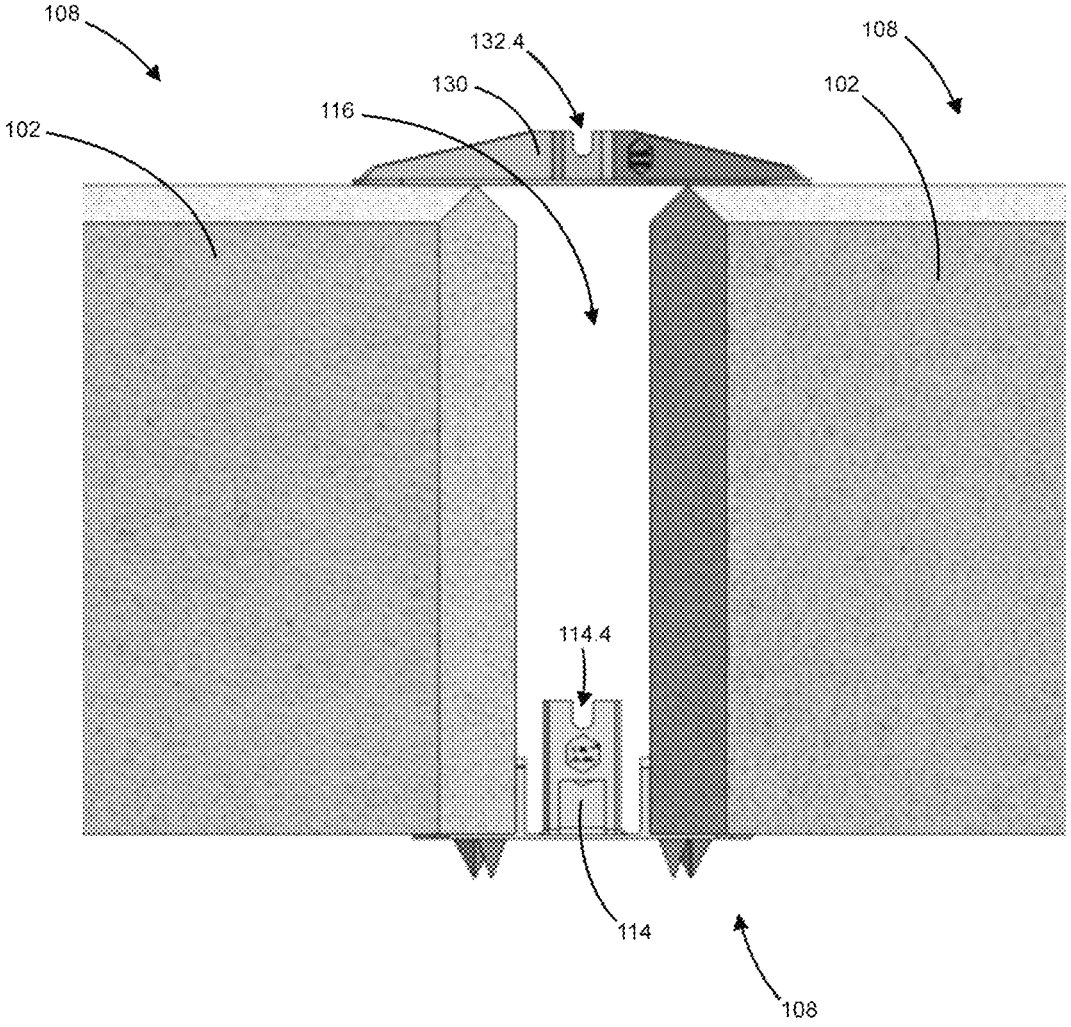
FIG. 10 shows a side view of two minor void forming formations being connected side-by-side to define a major void forming formation.

In FIG. 10, a side view of two adjacent void forming members (102) forming part of a two adjacent minor void forming formations (108) are held together by a spacer (114) and a first additional spacer (130) to define two major void forming formations (116) on their sides. The void between the major void forming formations (116) will define a stiffening rib (120), (see FIG. 2) when filled with a settable material. As can be seen, the semi-circular cut-outs (114.4) and (132.4) are for holding reinforcing bars in position when the settable material is poured into the void between the major void forming formations (116).

Figure 11:
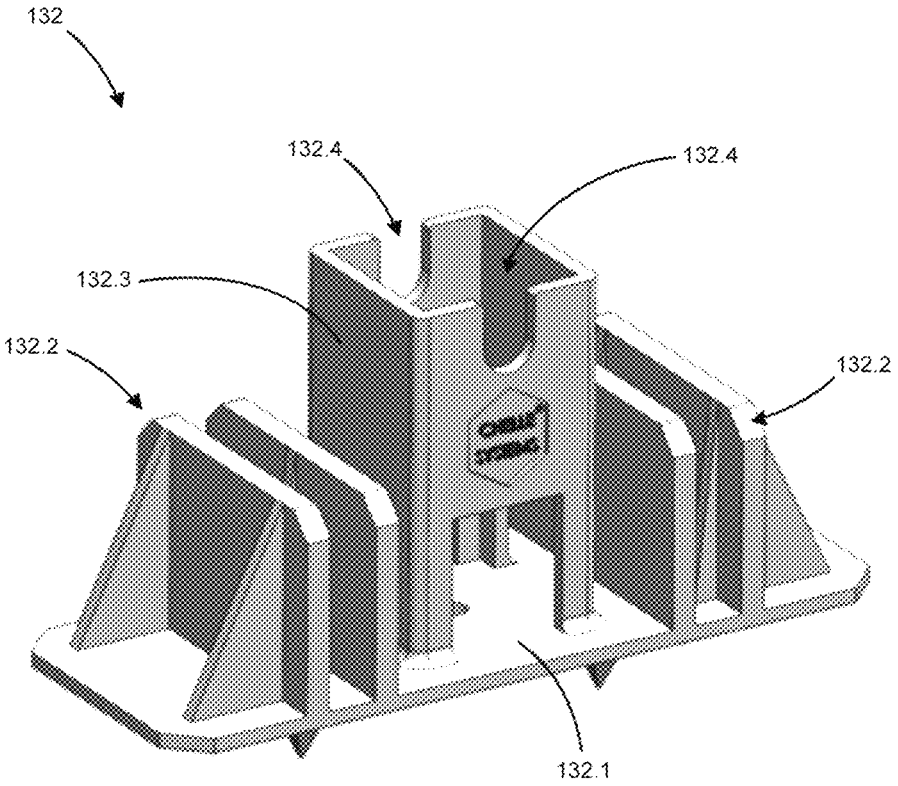
FIG. 11 shows a three-dimensional view of the second additional spacer.

As can be seen in FIG. 11, a second additional spacer (132) are provided to connect to the edges of two sets of minor void forming formations, thereby to connect them together. The second additional spacer (132) also includes a planar base (132.1), holding formations (132.2), a pillar (132.3) and semi-circular cut-outs (132.4) for receiving reinforcing bars.

Figure 13:
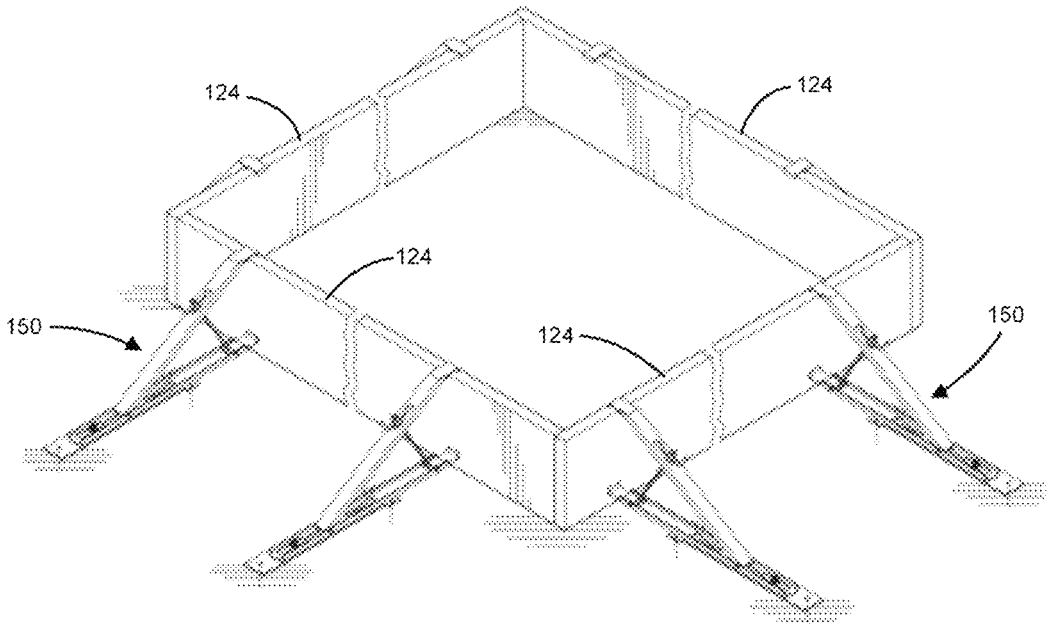
FIG. 13 shows the clamps and shuttering in use prior to insertion of the void forming members.

In FIG. 13, a portion of the shuttering described above is shown. The shuttering boards are manufactured from wood cladded polystyrene boards (124). The shuttering boards can be connected together with a bracket (not shown) at their corners and are held in position by means of clamps (150), in accordance with another aspect of the invention.

Figure 12:
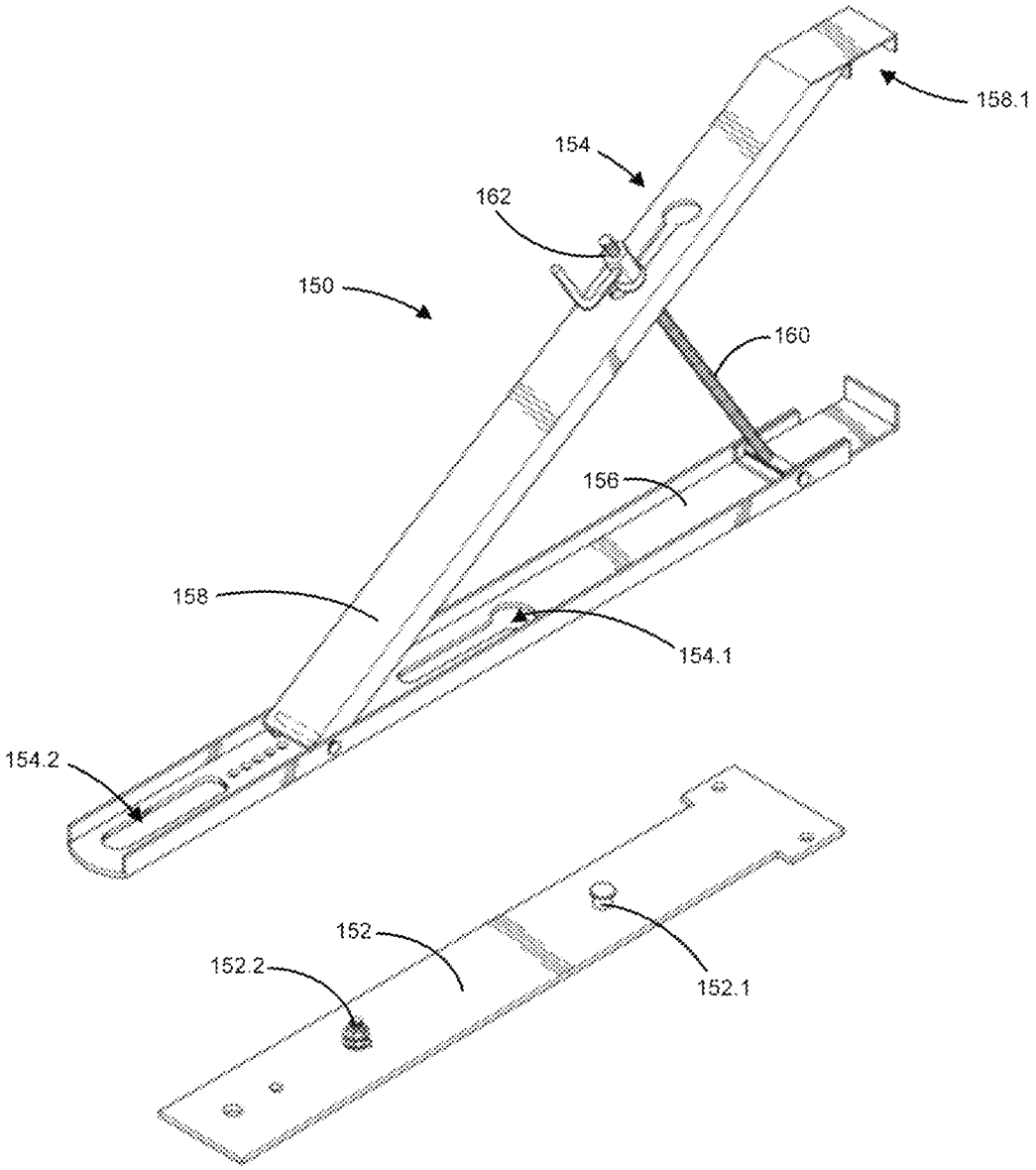
FIG. 12 shows a three-dimensional view of a clamp used to secure shuttering boards at the perimeter of the foundation.

As can be seen in FIG. 12, a clamp (150) comprises two parts. The first part is a T-section baseplate (152) which is placed in position when the excavation site is set out and excavated in step (16) above. Once placed, the T-section provides an accurate position for placement of the second part of the clamp. The T-section (152) is provided with an alignment pin (152.1) and a fastening stud (152.2) onto which the second part of the clamp (150) is removably mountable.

The second part of the clamp (150) is a gripper (154) with a base (156) that can fit onto the alignment pin (152.1) and the fastening stud (152.2), by means of a keyhole shaped slot (154.1) and an elongate slot (154.2) in the base. An adjustable arm (158) is pivotally mounted onto the base (156) and is adjustable by means of a threaded rod (160) and nut (162) combination to clamp the arm (158) and the base (156) together. Slots (156.1) (158.1) are formed in the base (156) and the arm (158) respectively to receive the shuttering boards (124) in position.

In the method, once the T-section (152) was nailed into the site, the shuttering (124) is placed in position by means of the gripper (154) being fitted onto the T-section (152), the gripper (154) being attached to the T-section (152) and the shutter boards (124) being clamped into position by the gripper (154). This method provides an accurate way to place the shutter boards (124) into the correct position.

The inventor believes that the invention provides a novel kit for constructing a foundation, a constructed foundation and method of construction said foundation which overcomes the problems associated with current "waffle" type floating foundations.

The invention claimed is:

1. A casting kit for constructing a foundation, the casting kit comprising:

a plurality of void forming members, each of which has a securing element on at least one side to secure the void forming member to a securing element of a matched void forming member thereby to define a minor void forming formation, wherein the minor void forming formation is defined by four void forming members secured to one another with step formations between the void forming members forming a cross-shaped groove running across a top face of the minor void forming formation, and wherein, in use, a first set of tensile elements and settable material are received in the groove to form supporting ribs;

a spacer shaped and dimensioned to secure the four sets of four minor void forming formations to one another while maintaining a gap between adjacent sets of four minor void forming formations to define a major void forming formation, wherein, in use, a second set of tensile elements and settable material are received to define stiffening ribs in the major void forming formations; and shuttering that, in use, is arranged around the major void forming formations to create edge beams in a foundation site when settable material is cast around the major void forming formations.

2. The casting kit as claimed in claim 1, wherein the first set of tensile elements and/or the second set of tensile elements are reinforcing steel bars.

3. The casting kit as claimed in claim 1, wherein the void forming member is in the form of a cuboid having a hollow interior with a planar top face.

4. The casting kit as claimed in claim 3, wherein the interior of the void forming member has integrally formed supporting formations in the form of a prism shaped structure.

5. The casting kit as claimed in claim 4, wherein the prism shape is a triangular prism, a square prism, a pentagonal prism or a hexagonal prism.

6. The casting kit as claimed in claim 1, wherein the securing element is in the form of a tongue and groove joint.

7. The casting kit as claimed in claim 6, wherein the tongue and groove joint is located in a lower portion of the void forming member.

8. The casting kit as claimed in claim 6, wherein the tongue and groove joint is located on sides of the step formations.

9. The casting kit as claimed in claim 1, wherein the spacer is in the form of a planar member with four holding formations on edges of the planar member, shaped and dimensioned to engage corners of four sets of four void forming members in a minor void forming formation.

10. The casting kit as claimed in claim 9, wherein the spacer comprises a central member extending upwardly from the planar member with four semicircular cut-outs capable of receiving the second set of tensile elements.

11. A method of constructing a foundation for a building which comprises;

providing a casting kit according to claim 1;

excavating in a foundation site boundary foundation trenches which defines the outer boundary of the foundation;

installing the shuttering on an outside of the boundary foundation trenches;

attaching the void forming members to one another to define the minor void forming formations, the grooves of the minor void forming formations defining moulds for supporting ribs and placing the minor void forming formations inside the shuttering;

securing the plurality of minor void forming formations in spaced relationship to one another to define the major void forming formation, the voids between the major void forming formations defining moulds for stiffening ribs;

placing the second set of tensile elements into the voids between the major void forming formations and the first set of tensile elements into the grooves in the minor void forming formations; and casting the settable material into the shuttering to form edge beams, supporting ribs, stiffening ribs and a slab on top of the void forming members covering the foundation site.

12. The method of claim 11, which comprises additionally excavating a grid of intersecting foundation trenches before installing the shuttering, the grid defined by two sets of substantially parallel trenches, the two sets of substantially parallel trenches intersecting each other, the grid of intersecting foundation trenches being in register with a major void forming formation to be installed between the trenches, the intersecting foundation trenches defining moulds for internal beams.

13. The method of claim 11, which comprises the prior step of levelling an area to obtain the foundation site and arranging a plurality of insulating panels abutting each other over the foundation site.

14. A foundation for a building formed using the casting kit of claim 1, the foundation comprising:

the plurality of void forming members positioned on top of a foundation site in a pattern of four adjacent void forming members with the step formations between the void forming members defining the minor void forming formations;

a plurality of the supporting ribs, formed by the first set of tensile elements and settable material cast into the minor void forming formations;

a plurality of a pattern of four adjacent minor void forming formations attached in spaced apart relationship to one another by the spacer, defining the major void forming formations; and the plurality of stiffening ribs, formed by the second set of tensile elements and settable material cast into the major void forming formations.

15. The foundation for a building as claimed in claim 14, further comprising a plurality of internal beams, formed by tensile elements and settable material, cast between a plurality of the pattern of four adjacent minor void forming formations to define internal beams extending into the surface of the foundation site.

16. The foundation for a building as claimed in claim 14, further comprising a reinforced slab extending over the void forming members between the edge beams.

* * * * *